United States Patent [19]

Brown

[11] Patent Number: 4,916,989

[45] Date of Patent: Apr. 17, 1990

[54] STRIP TENSIONING SYSTEM FOR A STRIP PEELING MACHINE

[75] Inventor: Robert L. Brown, Boston, Mass.

[73] Assignee: The Gillette Company, Boston, Mass.

[21] Appl. No.: 266,773

[22] Filed: Nov. 3, 1988

[51] Int. Cl.[4] ..... B23B 5/00

[52] U.S. Cl. ..... 82/48; 82/47; 29/17.1; 29/17.8; 226/42; 144/209 R

[58] Field of Search ..... 29/18; 82/1 C, 2 B, 82/DIG. 5, 47, 48, 1 R, 2 R, 2.5; 226/42; 144/2 R, 209 R, 211, 213

[56] References Cited

U.S. PATENT DOCUMENTS

| | | | |
|---|---|---|---|
| 1,701,889 | 2/1929 | Junker . | |
| 2,642,764 | 6/1953 | Porth | 80/60 |
| 2,821,492 | 1/1958 | Berdis | 134/15 |
| 2,877,397 | 3/1959 | Poschner | 226/42 |
| 2,916,956 | 12/1959 | Salomon | 83/163 |
| 3,112,052 | 11/1963 | Johnson | 226/42 |
| 3,262,182 | 7/1966 | Duret et al. | 29/18 |
| 3,330,497 | 7/1967 | Deschaine | 242/78.8 |
| 3,355,971 | 12/1967 | Vigor | 82/47 |
| 3,363,297 | 1/1968 | Snyder | 29/18 |
| 3,397,438 | 8/1968 | Montoro | 29/18 |
| 3,460,366 | 8/1969 | Musial et al. | 72/324 |
| 3,461,703 | 8/1969 | Ranney | 72/183 |
| 3,635,417 | 1/1972 | Kajiwara et al. | 242/78.8 |
| 3,746,229 | 7/1973 | Feller et al. | 226/91 |
| 4,070,739 | 1/1978 | Hague et al. | 29/18 |
| 4,075,747 | 2/1978 | Hague et al. | 29/18 |
| 4,085,496 | 4/1978 | Malkani et al. | 29/527 |
| 4,213,231 | 7/1980 | Middlemiss et al. | 29/18 |
| 4,274,315 | 6/1981 | Varner | 82/47 |
| 4,389,868 | 6/1983 | Strout | 72/132 |
| 4,771,519 | 9/1988 | Strout | 29/18 |

FOREIGN PATENT DOCUMENTS

| | | |
|---|---|---|
| 0024827 | 11/1981 | European Pat. Off. . |
| 2001569 | 2/1979 | United Kingdom . |
| 2055067 | 2/1981 | United Kingdom . |

OTHER PUBLICATIONS

"Strip Fabrication from Powder Metal Using Hip/Peeling Techniques", Robert L. Brown, *Progress in Powder Metallurgy* 1987 *Annual Meeting Powder Metallurgy Conference Proceedings*, vol. 43, Jun. 1987, pp. 337–349.

"Controlled Pull Creates Steel Strip", *Machine Design*, Jul. 21, 1988, pp. 50–51.

"Observations on the Peeling of a Composite GI-N-B/420 Stainless Steel/42 Alloy Ring", Robert L. Brown, Jan. 5, 1988, pp. 1–9.

*Primary Examiner*—Judy Hartman
*Assistant Examiner*—Jack W. Lavinder
*Attorney, Agent, or Firm*—Hamilton, Brook, Smith & Reynolds

[57] ABSTRACT

A strip tensioning system for a strip peeling machine is arranged to control the tension exerted on a metal strip being peeled from a rotating billet by a cutting tool. Regulation of the peeled strip tension at the cutting point operates to control the thickness and shape of the peeled strip.

13 Claims, 2 Drawing Sheets

STRIP TENSIONING SYSTEM FOR A STRIP PEELING MACHINE

BACKGROUND OF THE INVENTION

This invention relates to a system for controlling apparatus used for peeling and coiling a continuous strip of metal cut from a rotating billet, and more particularly, to a system for tensioning and examining the strip during operation of the machine.

Machines have been built to manufacture thin metal strips by continuously feeding or moving a cutting tool at a specific rate into the peripheral surface of a rotating metal billet so as to cut and peel a continuous metal strip therefrom. The cylindrical billets used for strip peeling are formed through the compression of metal powders typically comprised of high temperature alloys such as stainless steel alloys.

Existing machines have utilized a tension producing coiling assembly as part of the peeling process. The coiling assembly can include a motor driven rotatable spindle with a wrapping mechanism to assist in the threading of the peel onto the coiler. The rotating spindle pulls and coils the metal strip as it is peeled from the billet.

Control systems have been developed whereby the surface speed of the billet, the speed of the peeled strip and the rate of advancement of the cutting tool into the surface of the billet can be adjusted to accurately control the thickness of the strip. U.S. Pat. No. 4,274,315 discloses such a control system wherein sensors are used to monitor the thickness of the strip and correct for unwanted variations thereof.

Monitoring and control of strip tension is of particular importance in applications where the strip tension varies during the peeling operation. Such variations can arise due to an abrupt change in the metallurgy of the billet, because of any change in the rate of cooling at the cutting edge or due to a buildup of debris on the tool surface. A control circuit can be used to gather and process information from the various system components to maximize operating speed of the machine.

SUMMARY OF THE INVENTION

The present invention utilizes a capstan tensioning system to apply tension to the peeled strip during peeling. Previous machines have used the coiler on which the peeled strip is wrapped to apply the tension necessary to control the thickness of the peeled strip. A sensor has been used to monitor tension in the peeled strip and regulate the drive motor for the coiler in order to maintain a predetermined level of tension in the peeled strip. The capstan tensioning system of the present invention replaces the coiler tensioning system found in existing strip peeling systems.

A preferred embodiment of the capstan tensioning system comprises a pair of pinch rollers is placed along the path of the peeled strip between the cutting tool and the take up coiler. These rollers are independently driven to control the tension of the strip between the billet and the rollers. The rollers open for the convenience of threading, and after closing, rotate 180° relative to each other to become a capstan system for better gripping of the peeled strip. At least one of the rollers is fitted with a torque meter and driven by an independently controlled motor. The second roller may also be driven by a sprocket assembly connected to the drive spindle of the first roller. Strip tension can be sensed with a normal load cell at the capstan.

A second pinch roll capstan can be used between the first capstan and the coiler to evaluate strip shape and make adjustments to control the resulting strip shape. The second capstan can be independently driven in the same manner as the first capstan. Then by displacing the first capstan in a vertical plane the shape of the strip can be controlled. The strip can be examined without tension or at reduced tension between the first and second capstans with sensors to evaluate its shape before it is wrapped on the coiler. This provides a more sensitive control system than those presently in use and provides a means of independently controlling strip coiling tension.

A data processing system is used in which a memory is programmed with predetermined values for the speed of billet rotation, the translation rate of the cutting tool and the amount of tension applied by the pinch roll system. The sensors provide feedback signals to the computer to automatically adjust for variations in strip thickness and shape that can occur during the peeling process.

DETAILED DESCRIPTION

Figure 1:
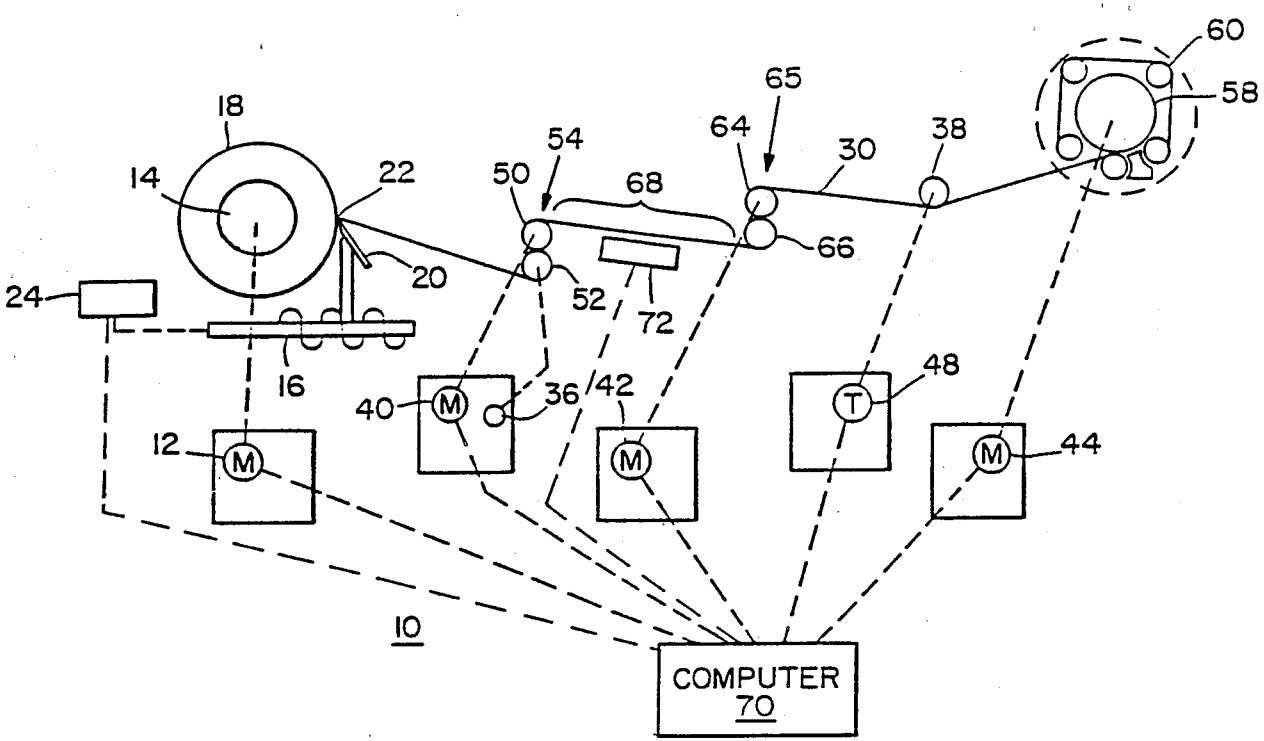
FIG. 1 is a schematic drawing of a strip peeling machine and related control systems for a preferred embodiment of the invention.

Referring to FIG. 1, there is shown a schematic block diagram of a control system 10 for a peeling machine having a variable speed d.c. drive motor 12 arranged to rotate a main spindle 14. The main spindle 14 is adapted to provide a stable support for a billet 18 of the material to be peeled, such as metal. The lead screw 16 positions and drives a cutting tool 20 suitable for cutting the material of the billet 18.

When the billet 18 is securely mounted on the spindle 14, the motor 12 is actuated to rotate the spindle 14 at a predetermined rate of speed which varies during the course of the peeling process. The lead screw 16 is driven by another d.c. motor 24 in a direction that feeds or advances a cutting edge 22 on the cutting tool 20 into the surface of the rotating billet 18 to produce a metal strip 30. A coolant (not shown) is often sprayed onto the tool and strip to control the temperature of the tool and strip.

A tachometer 48 can be used to monitor the speed of the strip 30 at some point between the cutting tool and a coiler spindle 58. It is preferable that the strip speed be constant during peeling to provide uniformity in the peeled strip. Note that this requires that the spindle 14 must rotate faster as the ring or billet 18 becomes smaller during the peeling operation. The rate of advancement of the cutting tool must also be increased to maintain strip speed as the radial thickness of the billet 18 is reduced.

The rate of advancement of the cutting tool 20 or feed rate is controlled by a d.c. motor 24 which is synchronized with the speed of the main spindle 14 and the tension on the strip. The motor 24 is adapted to permit an operator to select any discrete feed rate suitable for a particular operation. Alternatively, the feed rate of the tool could be controlled along with the other drive motors by a computer system 70. The computer 70 has a memory that can be programmed with specific values for each of the drive motor speeds during the course of the entire peeling process.

In operation, the machine is threaded by hand at a reduced rate onto an automatic wrapping device or machine 60. The threading speed can be set over a large range, however, a typical speed would be about 38 meters/minute. Such a machine is more fully described in U.S. Pat. No. 4,389,868. A strip 30 is cut or peeled from the billet the cutting tool 20. The cut strip 30 is manually surface which is rotated against the cutting edge 22 of threaded between a first pair of pinch rollers 50 and 52, through a second pair of pinch rollers 64 and 66, and finally wrapped on a spindle 58 rotatably driven by another variable speed motor 44. Tension is applied to the strip 30 as it is being wrapped around the wind up spindle 58 during threading of the strip 30. The spindle 58 pulls the strip 30 as it rotates about its longitudinal axis and wraps the strip 30 around itself.

After manual threading, the machine is switched into run mode and the strip speed is accelerated to a speed of about 60 meters/minute or faster depending upon the desired strip properties. The pulling force or tension applied to the strip 30 is an important factor determinative of strip thickness and shape. This force is a longitudinal tensile force applied on a plastic deformation zone in the strip at the cutting point. This applied force equalizes the non-uniform strains resulting from the metal cutting operation. A typical value for the peeling tension is about 250 lbs.

Generally strip thickness runs between 100 and 200 microns depending upon the particular application. Depending upon the alloy composition, the peeled material can be quite brittle and may crack if not properly handled. The peeled thickness can be controlled to within 5% of the total strip thickness.

It has been determined that the resultant strip thickness is generally not equal to the depth of the cut or infeed of the cutting tool 20 into the peripheral surface of the billet. During the cutting operation, the material ahead of the cutting tool 20 is plastically sheared causing a cut strip to "gather" up to two and one half times the thickness of the depth of cut. The ratio of the resultant strip thickness to the depth of cut is termed "gather ratio". The gather ratio is dependent upon the material being cut, the tool rake angle, the cutting speed, the billet speed and the tension applied to the material being cut from the billet 18. Increasing the tension applied to the strip 30 lowers the gather ratio and the resultant thickness of the strip 30 by placing the strip material under tensile stress and thereby decreasing the plastic shear ahead of the cutting edge. Therefore the greater the tension that is applied to the strip 30, the thinner the strip 30 becomes and the faster it travels. Conversely, lowering the tension decreases the tensile stress in the strip 30 and allows it to thicken and travel slower. It is also possible to obtain a thin strip by using both a slow cutting tool feed and low strip tension. Thus, the gather ratio is also the ratio of the surface speed of the billet, $B_{SS}$, to the speed of the strip, LS. Note that the gather ratio equals the ratio of billet surface speed/strip speed which equals the ratio of thickness/feed rate.

Electronic circuits are arranged to maintain a uniform strip thickness by controlling the ratio of the billet surface speed to the strip speed since the strip thickness is substantially equal to the product of the cutting tool feed rate multiplied by the gather ratio.

Synchronization of the spindle speed, tool traverse rate, capstan speed, and the wind-up coiler speed is performed by a programmable computer control system 70. The d.c. drive motors 12, 24, 40, 42 and 44 for the main spindle 14, tool feed 16, the first capstan 54, the second capstan 65 and the coiler spindle 58 respectively, are all controlled by computer 70. A tachometer 48 can be used to monitor the speed of the strip 30 using roller 38 positioned between the second capstan 65 and the coiler spindle 58. The tension of the strip 30 between the first capstan 54 and the billet is monitored by meter 36 which can be secured to roller 52. The memory of the computer 70 is used to compare the sensed parameters of the peeled strip to certain programmed values and adjust the speed of the drive motors to maintain the sensed parameters within predetermined ranges. A programmed shutdown of the machine occurs at a predetermined end point in the cutting of the ring.

Figure 2A:
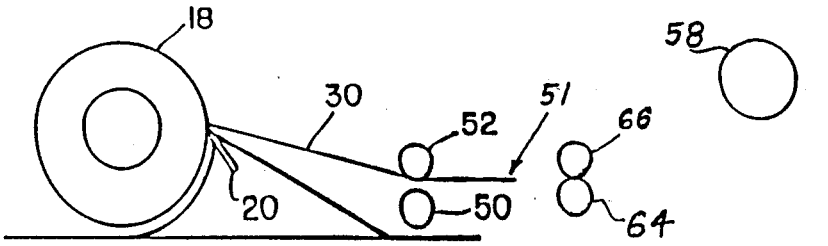
FIGS. 2A–2E schematically illustrate the different operating modes of a preferred embodiment of a tensioning system for a strip peeling machine.
Figure 2B:
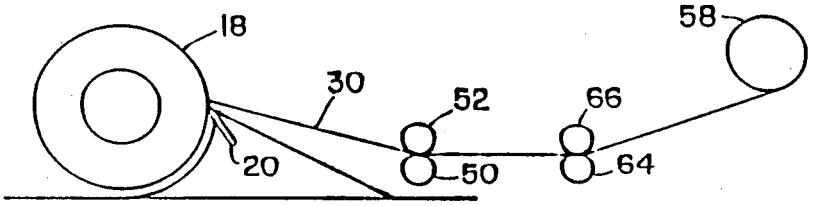

FIGS. 2A–2E show in greater detail the various operating modes of a preferred embodiment of the tensioning system for a strip peeling machine. In particular FIG. 2A depicts the pair of pinch rollers 50 and 52 that have been opened to permit threading of the peeled strip 30 into the wrapping machine 60 shown in FIG. 1 which initially wraps the spindle 58. Note that threading is much easier than prior art machines as the pinch rollers limit bending and breaking of the strip while it is drawn onto the spindle 58. The leader portion 51 of the strip 30, which is quite distorted before tension is applied, is cropped before the strip is wound. After initial coiling the wrapping machine 60 is removed, and the pinch rollers 50 and 52 are then brought together as shown in FIG. 2B, and the threading of the machine is completed. Note that the strip tension is provided by the rollers 50 and 52 and the motor 40 during threading by using a preprogrammed speed for the motors 12 and 40 to give a desired stretch in the strip. After threading the tension will be automatically controlled by the computer 70.

Figure 2C:
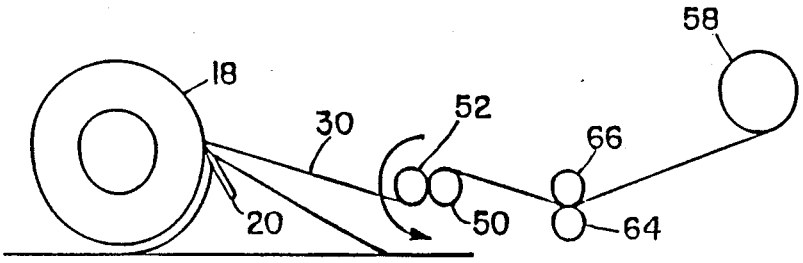

Roller 52 is then rotated counterclockwise around roller 50 as shown in FIG. 2C to assume a capstan configuration.

Figure 2D:
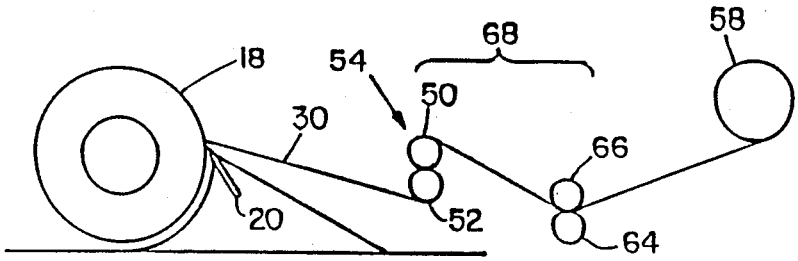

FIG. 2D shows the system in the running mode with the rollers 50 and 52 positioned 180° from their position during threading to apply the tensile force to the strip 30 and act as a capstan 54. This configuration provides for a sufficient contact area between the rollers 50 and 52 and the strip 30 so that the capstan 54 can apply a controlled amount of force on the strip 30 between the billet 18 and the capstan 54. In a typical system the rollers 50 and 52 are four inches in diameter thereby providing in excess of 8 inches of contact length between the rollers and the strip 30. The rollers are generally comprised of steel with a urethane cover although other materials can be used which provide sufficient friction when engaging the strip.

Figure 2E:
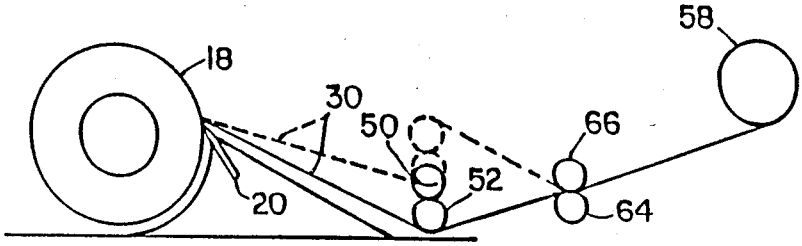

FIG. 2E illustrates the capacity of the capstan to be raised or lowered in a vertical plane and thereby vary the "take off" angle. In a preferred embodiment the "take off" angle of strip 30 from the billet 18 can be adjusted by as much as twenty degrees. Lowering or raising the capstan varies the "take off" angle and with it the shape of the peeled strip.

A second set of pinch rollers 64 and 66, can be positioned between the first pair of rollers 50,52 and the coiler 62. This second pair of rollers can also be configured as a capstan to isolate the region 68 between the first and second set of rollers from the tensioning of the strip that occurs between the billet and rollers 50,52, and between the rollers 64,66 and the coiler spindle 58. This relatively tension free region 68 permits the natural shape of the strip to be examined with an optical sensor 72 while it passes through region 68. The strip shape can the be more finely adjusted during peeling based on the examination of strip shape.

Although the invention has been described in connection with certain preferred embodiments, it should be clear that various changes and modifications can be made without departing from the spirit and scope of the claimed invention. For example, a wide variety of systems may be employed in driving and controlling the tensioning system described herein.

I claim:

1. A strip tensing system for a strip peeling machine comprising:

a rotatable billet;

a cutting tool to peel a strip from the billet, the cutting tool being movable relative to the surface of the billet in response to a control signal;

a coiler to take up the peeled strip;

a pair of pinch rollers positioned along a path of the strip between the coiler and the billet to apply tension to the peeled strip;

a motor to drive at least one of the rollers;

a tension sensor to sense the level of tension in the strip and to generate a signal indicative thereof; and a feedback control circuit to receive the signal from the tension sensor and generate the control signal to correlate the movement of the cutting tool relative to the billet with the speed of the motor and thereby adjust the tension applied to the strip by the pair of rollers.

2. The strip tensioning system of claim 1 wherein the rollers are adjustable in a vertical plane to control the shape of the strip.

3. The strip tensioning system of claim 1 wherein the rollers form a capstan between which the peeled strip is threaded and grasped by the rollers.

4. The strip tensioning system of claim 1 further comprising a second pair of pinch rollers such that the strip is grasped by the second pair of rollers between the first pair of rollers and the coiler.

5. The strip tensioning system of claim 1 further comprising a data processor to control relative speeds of the billet, the tool and the control element.

6. A strip tensioning system for a strip peeling machine comprising:

a rotatable billet;

a cutting tool to peel a strip from the billet, the cutting tool being movable relative to the surface of the billet;

a coiler to wind the peeled strip extending along a path between the billet and the coiler;

a first pair of independently driven rollers between which the strip passes, said first roller pair being positioned along the path of the strip between the billet and the coiler, the first pair of rollers being driven by a first drive motor to apply tension to the peeled strip between the billet and the roller; and a second pair of independently driven pinch rollers between which the strip passes, said roller pair being positioned between the first roller pair and the coiler, the second pair of rollers being driven by a second drive motor to control the tension of the strip and thereby provide a tension isolated region along the path of the strip between the first and second pairs of pinch rollers such that the tension of the strip in the isolated region is independently controllable.

7. The strip tensioning system of claim 6 wherein the second pair of pinch rollers is rotatable into a capstan configuration.

8. The strip tensioning system of claim 6 wherein each pair of rollers is driven by first and second drive motors such that the second pair of rollers controls the tension of the strip as it is wound onto the coiler.

9. The strip tensioning system of claim 8 further comprising a data processor to control speeds of the billet, the tool, the coiler and the first and second drive motors.

10. A method of tensioning a peeled strip comprising:

rotating a billet of material to be peeled;

cutting a peeled strip of material from the billet with a cutting tool movable in response to a first motor;

applying tensile stress to the peeled strip as it is cut from the billet with a pair of pinch rollers driven by a second independently driven motor;

providing a tension sensor and a tension feedback control loop which senses the tensile stress applied to the peeled strip and generates a tension feedback signal;

modifying the speed of the second motor with the feedback signal to adjust the tensile stress on the peeled strip;

substantially reducing the tensile stress of the peeled strip along a portion of a path of the strip between the billet and a coiling position; and coiling the peeled strip under tensile stress.

11. The method of tensioning a peeled strip as in claim 10 further comprising the step of monitoring the strip shape along the portion of the strip path having reduced tensile stress.

12. The method of tensioning a peeled strip as in claim 11 wherein the shape is controlled by adjusting an angle at which the strip is removed from the billet.

13. The method of tensioning a peeled strip as in claim 10 further comprising the step of programming a memory with predetermined parameters to control speeds of rotation and cutting, and to control the application of stress to the peeled strip.

* * * * *